US006252190B1

(12) United States Patent
Niemeyer

(10) Patent No.: US 6,252,190 B1
(45) Date of Patent: Jun. 26, 2001

(54) ELECTRICAL HIGH SPEED CIRCUIT BREAKER WITH EXPLOSIVE CHARGES INCLUDING ABLATIVE ARC EXTINGUISHING MATERIAL

(75) Inventor: Lutz Niemeyer, Birr (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/477,368

(22) Filed: Jan. 4, 2000

(30) Foreign Application Priority Data

Jan. 11, 1999 (DE) ..... 199 00 666

(51) Int. Cl.[7] ..... H01H 33/00

(52) U.S. Cl. ..... 218/1; 218/43; 218/57; 218/59; 218/85; 218/90

(58) Field of Search ..... 218/1, 56, 85, 218/90, 117, 149–151, 155–158, 57–67; 335/201; 337/401–417; 200/61.08

(56) References Cited

U.S. PATENT DOCUMENTS

| | | | | |
|---|---|---|---|---|
| 4,224,491 | * | 9/1980 | Kroon | 218/95 |
| 4,250,365 | * | 2/1981 | Mc Connell | 218/95 |
| 4,342,978 | * | 8/1982 | Meister | 337/401 X |
| 5,535,842 | * | 7/1996 | Richter et al. | 200/61.08 X |
| 6,107,590 | * | 8/2000 | Skindhoj et al. | 218/1 |

FOREIGN PATENT DOCUMENTS

| | | |
|---|---|---|
| 1 020 082 | 11/1957 | (DE) . |
| 35 37 314 | 4/1987 | (DE) . |
| 35 45 327 | 6/1987 | (DE) . |
| 36 21 186 | 1/1988 | (DE) . |
| 196 13 568 | 10/1997 | (DE) . |

* cited by examiner

*Primary Examiner*—J. R. Scott
(74) *Attorney, Agent, or Firm*—Burns, Doane, Swecker & Mathis, L.L.P.

(57) ABSTRACT

A simple high-speed circuit breaker which is cheap to produce is specified for alternating currents which have to be switched off, which switches such currents off within one half-cycle at the current zero crossing, by means of a gas-generating explosive charge (4). In this case, a switching piston (2) which makes a sliding contact with a consumable contact pin (K1) of a first electrode (E1) when the high-speed circuit breaker is closed, moves in the direction of a hollow electrode (E2). The switching piston (2) has a contact tube (2') with an exhaust opening (3) which is closed by the hollow electrode (E2) when the high-speed circuit breaker is closed, and is open to an exhaust chamber (8) when the high-speed circuit breaker is open (left-hand half of the figure). The contact tube (2') moves in a sliding manner in a cutout in the hollow electrode (E2). A plurality of explosive charges (4) may be accommodated in the first electrode (E1). In addition, rated current contacts which are provided between the first electrode (E1) and the switching piston (2) carry a continuous current when switched on. The high-speed circuit breaker is particularly suitable as a circuit breaker in addition to a power breaker, in which case the high-speed circuit breaker is tripped if the power breaker fails.

7 Claims, 2 Drawing Sheets

ELECTRICAL HIGH SPEED CIRCUIT BREAKER WITH EXPLOSIVE CHARGES INCLUDING ABLATIVE ARC EXTINGUISHING MATERIAL

FIELD OF THE INVENTION

This invention relates to electrical high-speed circuit breakers of the type having a gas generating explosive charge for quenching an arc.

The invention also relates to use of the high-speed circuit breaker.

BACKGROUND OF THE INVENTION

Patent No. DE 35 37 314 A1 discloses an apparatus for interrupting current in which an electrical connection is disconnected by the explosion of an explosive charge. A tubular bridging contact composed of ductile material between a first and second electrode has notches internally as weak points, and has an explosive charge externally, inside a pressure chamber.

If the current to be monitored exceeds a current limit value which can be determined, the explosive charge is detonated. An arc produced in this case is blown by the mixed gas emerging from the pressure chamber, and is quenched at the next current zero crossing. A disadvantage in this case is that, apart from the explosive charge, the electrodes and the bridging contact also have to be replaced after each disconnection process. As a result of the arc, electro-negative gas is released, as a component of the mixed gas, from the lining of the inner wall of the pressure chamber, leading to consumption of the latter.

DE 19 613 568 A1 discloses a power breaker for operating voltages up to 30 kV, in which first and second electrodes are electrically conductively connected, when closed, by means of a moving, circular-cylindrical switching pin as a bridging contact. Between the electrodes, the switching pin is surrounded circumferentially by a pressure chamber. A rated current path, which is provided with moving rated current contacts, may be arranged in parallel with the power current path. When the power breaker is switched off, the rated current path is interrupted first of all, as a result of which the current commutates onto the power current path. Afterwards the power current path is interrupted. An arc is formed in the process, and is then quenched. The drive for the switching pin, which can reach a speed in the range of 10 m/s–20 m/s during switching, is not quoted in any more detail. The switching pin, which is connected to a relatively complex switching drive for a rated-current contact finger, is subjected to a high load during switching.

SUMMARY OF THE INVENTION

The invention achieves the object of further developing an electrical high-speed circuit breaker of the type mentioned initially, in such a manner that the design complexity for lines and switching devices is reduced.

One advantage of the invention is that there is no need to replace electrodes and the bridging contact after each switching operation. The simple design leads to cost savings.

The high-speed circuit breaker according to the invention can advantageously be used as a reserve circuit breaker for a main power breaker.

DETAILED DESCRIPTION OF THE INVENTION

Figure 1:
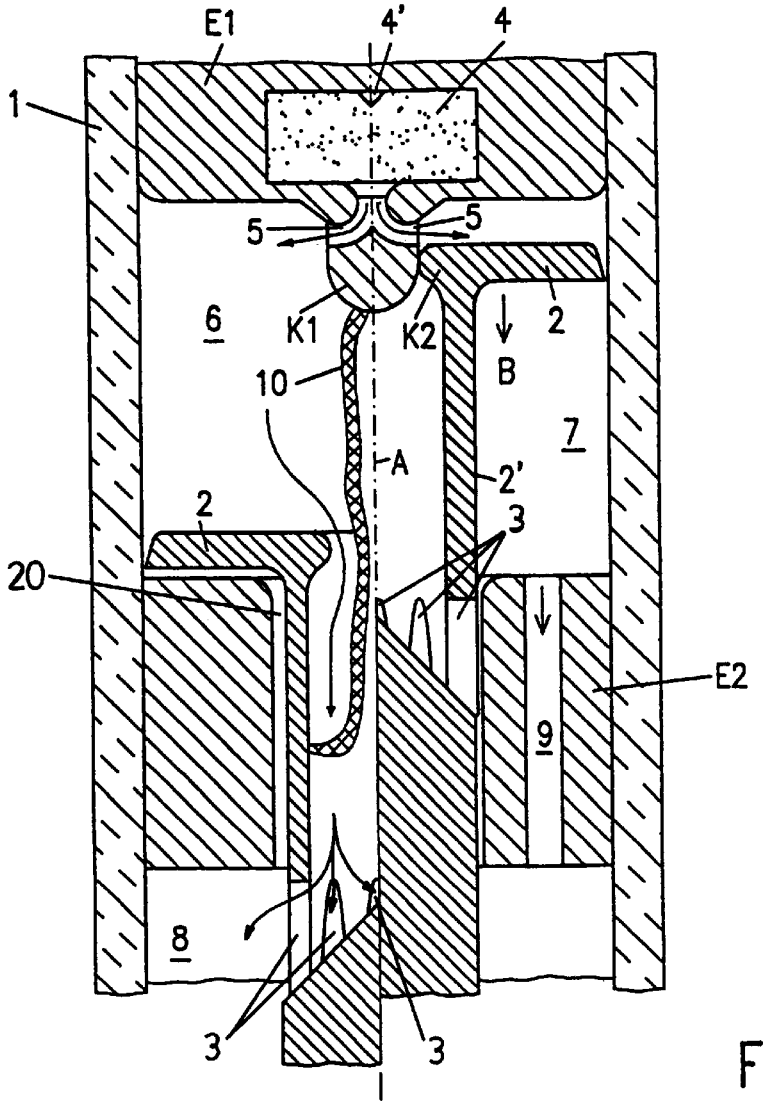
FIG. 1 shows, schematically, a cross section through the contact regions of a high-speed circuit breaker having an explosive charge, in the switched-on state on the right, and in the switched-off state on the left.

FIG. 1 shows, schematically, a cross-sectional view through the contact regions of a high-speed circuit breaker having an axis of symmetry or circuit-breaker axis (A), in the switched-on state on the right, and in the switched-off state on the left.

A first electrode (E1) having a consumable contact or consumable contact pin (K1) and having a gas-generating charge or explosive charge (4) on which a firing apparatus (4') is fitted, is arranged in the upper part of a circular-cylindrical circuit-breaker enclosure (1) such that it is gas-tight with respect to a high-pressure chamber (6) located underneath. A second electrode or hollow electrode (E2) is located in the lower region of the circuit-breaker enclosure (1), having a vent line (9) for venting a low-pressure chamber or piston chamber (7) into an exhaust chamber (8) underneath the hollow electrode (E2). When the high-speed circuit breaker is switched on, a tubular bridging contact or switching piston (2) on the one hand makes an electrically highly conductive sliding connection with the consumable contact pin (K1) via a current contact element (K2), and on the other hand makes the sliding connection with the inner wall of the circuit-breaker enclosure (1). This switching piston (2) has an axial, electrically highly conductive contact tube (2') which is arranged such that it can move in a central opening 20 in the hollow electrode (E2) and makes an electrically highly conductive contact with the wall of this central opening. In its lower region, the contact tube (2') has a gas outlet opening or exhaust openings (3), which are located underneath the upper surface of the hollow electrode (E2) when the high-speed circuit breaker is switched on, and are thus closed by said hollow electrode (E2). It is not possible for gas to escape from the high-pressure chamber (6) through the exhaust openings (3) in this switched-on position.

Detonation of this explosive charge (4) causes a chemical reaction in a similar way to that of a safety airbag in a motor vehicle, briefly releasing a large amount of gas, which flows through openings or explosion gas inlet openings (5) in the first electrode (E1), into the high-pressure chamber (6) where it produces a pressure in the range from 5 MPa to 10 MPa. This pressure drives the tubular switching piston (2) downwards in the movement direction of an arrow (B). In the process, the electrical contact between the consumable contact pin (K1) and the current contact element (K2) is interrupted, so that an arc (10) is formed between the consumable contact pin (K1) and the inner wall of the contact tube (2'), which arc (10) is lengthened as the piston continues to move. Once the switching piston (2) has reached its lower position, see the left-hand side of FIG. 1, then the exhaust openings (3) are exposed to the exterior, and the explosion gases can escape from the high-pressure chamber (6) into the exhaust chamber (8). In the process, the arc (10) is blown, and is caused to extinguish within one half-cycle of the alternating current to be interrupted, at the next current zero crossing. The vent line (9) in the hollow electrode (E2) ensures that the movement of the switching piston (2) is not braked by the gas that is compressed in the piston chamber (7).

Suitable design of the gas-generating explosive charge (4) allows the pressure in the high-pressure chamber (6) to be set such that 1. the movement of the switching piston (2) and thus the disconnection of the consumable contact pin (K1) from the current contact element (K2) take place within the desired short time of a few ms and
2. the blowing of the arc (10) which is produced when the explosion gas flows out is sufficient to interrupt the current and, possibly to produce a desired high arc voltage.

Pressures in the range of 5 MPa to 10 MPa can easily be reached; these allow contact disconnection times of a few ms, with a distance of about 10 cm between the first electrode (E1) and the hollow electrode (E2).

The volume of the exhaust chamber (8) is designed such that the residual pressure in the high-pressure chamber (6) is sufficient to ensure the desired dielectric strength of the open contact path.

After a switching operation, the high-speed circuit breaker can be made ready to switch again by resetting the contact tube (2') and replacing the gas-generating explosive charge (4). In the simplest case, this is done by manual servicing. However, the readiness for disconnection can also be automated by means of a mechanical resetting drive and an automatic reloading apparatus for the explosive charge (4) (not shown).

Figure 2:
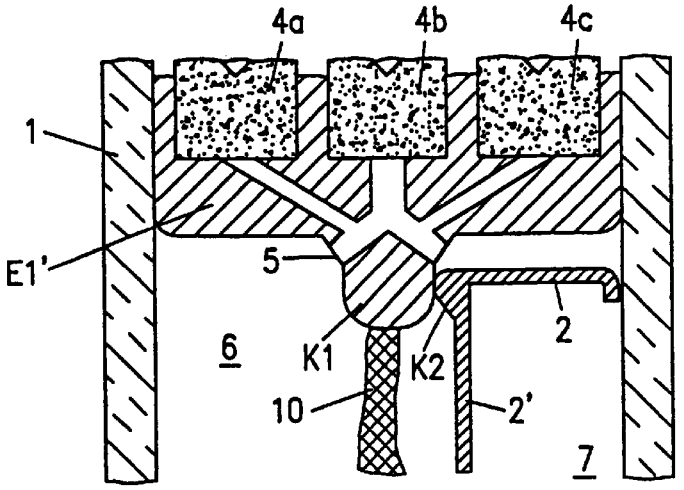
FIG. 2 shows, schematically, a cross section through a contact region of a high-speed circuit breaker having 3 explosive charges.

FIG. 2 shows, schematically, a cross-sectional view of a first electrode (E1') having a plurality of gas-generating explosive charges (4*a*, 4*b*, 4*c*) which can be detonated separately and successively as required, and which are connected to the high-pressure chamber (6) via separate supply channels. There is thus no need for an automatic reloading apparatus for applications when switching operations occur rarely.

Figure 3:
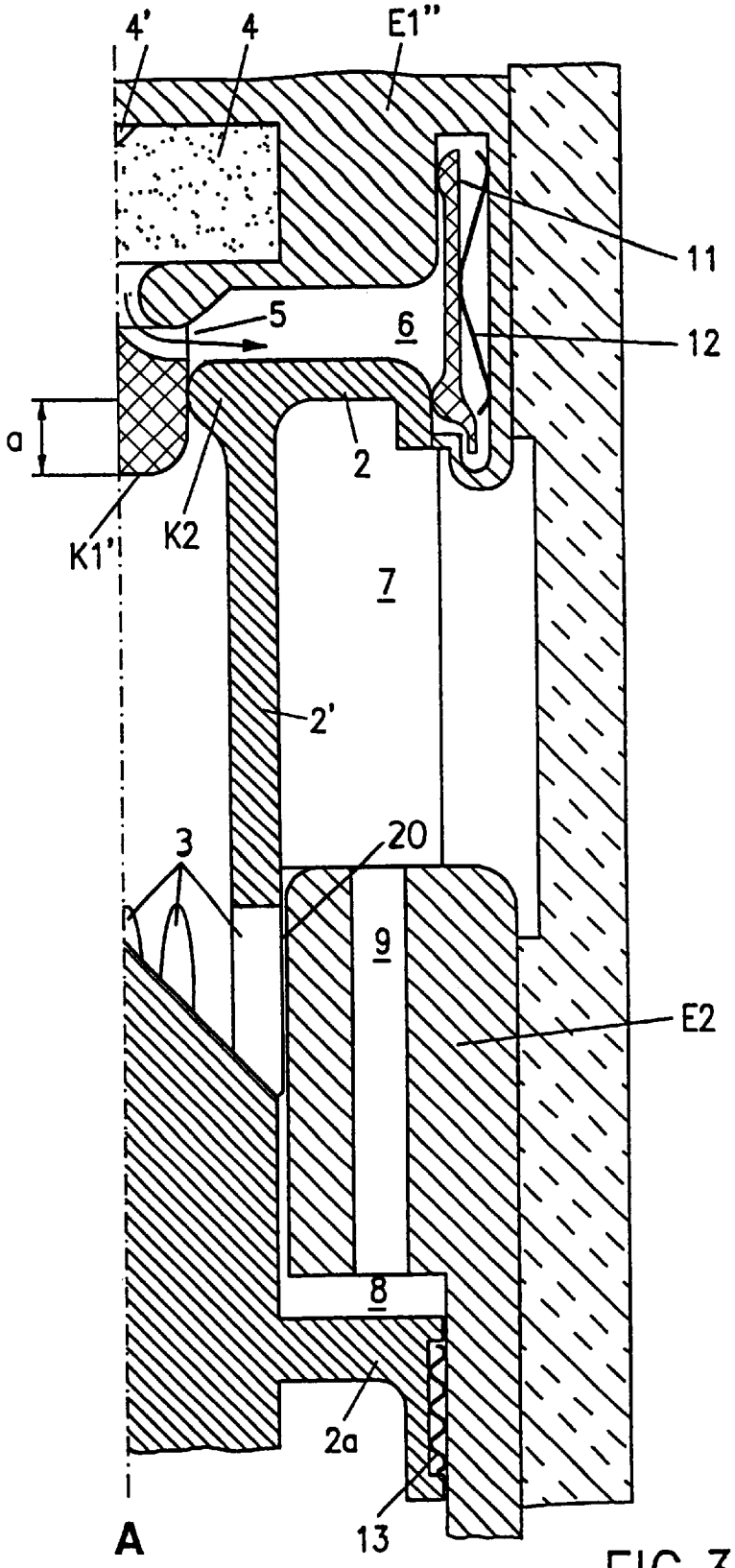
FIG. 3 shows, schematically, a cross section through the right-hand half of the contact regions of a high-speed circuit breaker having additional rated current contacts.

FIG. 3 shows, schematically, a cross-sectional view of the right-hand half of the contact regions of a high-speed circuit breaker, in which a plurality of finger contacts or rated current contacts (11), only one of which can be seen, are connected in parallel with arc quenching contacts (K1', K2) in order to increase the rated current carrying capacity. These rated current contacts (11) are arranged at the edge between a stationary first electrode (E1") and the moving switching piston (2) and are forced into contact by in each case one compression spring (12). The moving switching piston (2) is thus used to carry the rated current. The current is passed from this switching piston (2) via a plurality of webs (2*a*) which are rigidly connected to the switching piston (2) and one of which is illustrated in cross section, to a sliding contact (13), from where it is transmitted to the stationary hollow electrode (E2). The large radii on which the contact junctions are made allow high rated currents to be carried.

In order to ensure safe commutation from the rated current contacts (11) to the consumable contact pin (K1'), the latter is lengthened by an overlap distance (a) of, for example, 1 cm in comparison with the consumable contact pin (K1) in FIG. 1.

Instead of the sliding contacts (13), rated current contacts (11) may be used for the second rated current junction from the switching piston (2) to the hollow electrode (E2), as for the 1$^{st}$ first rated current junction from the first electrode (E1") to the switching piston (2).

It is self-evident that the current contacts may be designed other than as illustrated. Thus, for example, instead of a consumable contact pin (K1) projecting from the first electrode (E1), it is possible to provide a cutout in the first electrode (E1) which makes an electrically conductive sliding connection (not shown) at the edge with a current contact element (K2) of the switching piston (2). Such a contact cutout could also be provided in the consumable contact pin (K1).

The high-speed circuit breaker according to the invention may be used as an additional or back-up circuit breaker for a power breaker (not shown) whose switching capacity is not sufficient for the maximum short-circuit current to be expected. In such a situation, the high-speed circuit breaker could, for example, divert a portion of the short-circuit energy fed in in the center of a busbar, right at the start of a short-circuit, so that the existing power breaker need not be switched until after the end of the switching process in the high-speed circuit breaker, and is no longer overloaded by the reduced short-circuit current.

The high-speed circuit breaker according to the invention may also be used as a protective circuit breaker or back-up circuit breaker for a cheap "intelligent" power breaker designed for a relatively low rating, which switches off when the phase conditions of the current to be switched off are advantageous. If such a power breaker fails, as can be identified, for example, by the arc duration being too long, the high-speed circuit breaker is detonated and tripped. This allows the reliability of overcurrent protection to be improved considerably using cheap "intelligent" power breakers. Since such a failure of the power breaker occurs very rarely, the high-speed circuit breaker need be designed for only a few switching operations in this case. In most cases, single operation with subsequent servicing will be sufficient.

A high-speed circuit breaker used as a back-up circuit breaker is preferably tripped independently of the normal system protective system, for example by a tripping apparatus which is fed from the local current profile (not shown) that is to say independently of a tripping signal for the power breaker. If it is impossible to interrupt very high short-circuit currents at the right time, for example close to a generator, due to an imbalance and the resultant lack of zero crossings of the current to be switched off, then a high-speed circuit breaker which has built up a high arc voltage can force a premature current zero crossing to occur, and can thus ensure that the current is interrupted at the right time.

The high-speed circuit breaker according to the invention and of simple design may also be used as a recloseable protective element in high-voltage systems since, at the same time, it has a high rated current carrying capacity and a high response sensitivity. It can be designed for the maximum possible short-circuit current in the system to be protected and can switch this system off, if necessary, after one half-cycle.

The time delay between the occurrence of a tripping signal and the start of the movement of the switching piston (2) can be kept considerably shorter than one half-cycle owing to the high-speed electrical detonation and the high-speed chemical reaction.

What is claimed is:

1. An electrical high-speed circuit breaker comprising:

an enclosure, a stationary first electrode and a stationary second electrode spaced from the first electrode, a bridging contact in the enclosure, the bridging contact being mounted for movement between a closed position where the bridging contact connects the first electrode to the second electrode and an open position where the first and second electrodes are operated, the bridging contact being in the shape of a contact tube and including a piston element, the contact tube portion of the bridging contact being received in a cutout in the second electrode and the contact tube portion having an exhaust opening, the exhaust opening being closed by the second electrode when the piston element is in engagement with the first electrode, a gas generating explosive charge for quenching an arc, a conduit for conducting gas from the explosive charge to the piston element, whereby the gas from the explosive charge displaces the piston element of the bridging contact toward the open position and thereby uncovering the exhaust opening and allowing the gas to flow through the contact tube and extinguish the arc.

2. The electrical high-speed circuit breaker as claimed in claim 1, wherein a) the first electrode has a consumable contact element which forms an electrically conductive sliding connection with a current contact element of the switching piston when the high-speed circuit breaker is closed, and b) the switching piston closes this consumable element off in a gas-tight manner from the circuit-breaker enclosure of the high-speed circuit breaker.

3. The electrical high-speed circuit breaker as claimed in claim 1, wherein a) the switching piston bounds a high-pressure chamber on one side and b) a piston chamber on the other side which is connected to the exhaust chamber by a vent line in the second electrode.

4. The electrical high-speed circuit breaker as claimed in claim 1, wherein the explosive charge is mounted in a cutout in the first electrode.

5. The electrical high-speed circuit breaker as claimed in claim 4, including a plurality of explosive charges, each explosive charge is connected to the high-pressure chamber by a separate supply channel.

6. The electrical high-speed circuit breaker as claimed in claim 1, wherein the first electrode forms an electrically conductive slideing connection with the switching piston by a rated-current contact, when the high-speed circuit breaker is closed.

7. Use of an electrical high-speed circuit breaker as claimed in claim 1 as a circuit breaker in addition to at least one power breaker, in which case the high-speed circuit breaker is tripped if the power breaker fails.

* * * * *